United States Patent [19]

Stoody

[11] Patent Number: 5,005,733

[45] Date of Patent: Apr. 9, 1991

[54] FLACCID BAG BOTTLE FOR DISPENSERS

[76] Inventor: William R. Stoody, 8659 Summerdale Rd., San Diego, Calif. 92126

[21] Appl. No.: 337,151

[22] Filed: Apr. 12, 1989

[51] Int. Cl.[5] ..... B65D 35/56

[52] U.S. Cl. ..... 222/105; 222/107; 215/11.3; 383/905

[58] Field of Search ..... 222/105, 107, 92, 95, 222/206, 215; 215/11.1, 11.3; 383/35, 905, 44, 46, 48

[56] References Cited

U.S. PATENT DOCUMENTS

| | | | |
|---|---|---|---|
| 218,650 | 8/1879 | Weaver | 383/905 |
| 1,498,473 | 6/1924 | Mondschein | 383/905 |
| 3,353,714 | 11/1967 | Treck | 222/107 |
| 3,473,532 | 10/1969 | Eisenberg | 383/35 |
| 3,486,661 | 12/1969 | Friedrich et al. | 222/95 X |
| 3,508,587 | 4/1970 | Mauch | 138/119 |
| 4,147,278 | 4/1979 | Uhlig | 222/95 X |
| 4,216,900 | 8/1980 | Dederick | 383/905 |
| 4,232,721 | 11/1980 | Martin et al. | 222/107 |
| 4,657,151 | 4/1987 | Cabernoch | 215/11 E |

FOREIGN PATENT DOCUMENTS

| | | | |
|---|---|---|---|
| 2508172 | 9/1976 | Fed. Rep. of Germany | 215/11.3 |

*Primary Examiner*—Robert P. Olszewski
*Assistant Examiner*—Kenneth Noland

[57] ABSTRACT

A collapsible flaccid bag bottle, such as those used for baby bottles, for closed containment of fluid to be aspirated therefrom. Integral with the bottle is a thin passive film, for example, a 2 mil thick additional layer of plastic, that passively manages collapsing of the bottle as fluid is dispensed. The presence of this layer insures against sustainment and proliferation of fluid retention pockets that typically proliferate inside of flaccid bags and block discharge passage of fluid.

7 Claims, 1 Drawing Sheet

FLACCID BAG BOTTLE FOR DISPENSERS

BACKGROUND OF THE INVENTION

The present invention relates to a novel, collapsible, passive flaccid bag for use as a bottle in various kinds of dispensers, such as a squeeze bottles, aerosols, and pumps, for closed containment dispensable fluid product. This flaccid bag incorporates a passive guide means that influences the manner in which the bag collapses, without regard to the attitude of the bag.

The bag of the present invention provides an important advantage, in that, it can be used with spray pumps to facilitate discharge of product in any direction. In such use the bag progressively collapses, coincidental with aspiration of the product, and remains in a collapsed state between intervals of aspiration. Collapsing of the bag keeps the product in communication with the pump.

The present invention takes into account two basic bag collapsing principles, established by the Inventor: (1) under uniformly distributed external pressure, collapsing of the bag walls proceed along a path of least resistance; (2) aspiration of fluid from a closed flaccid bag causes the bag walls to move in the outlet direction along a path of least resistance. The collapsing manner of the bag has been predicated to be attributable to resistance, and therefore it is manageable.

At this point it is important to understand that under uniformly distributed external pressure, complete collapsing of the bag proceeds from the region of the bag that is furthermost from the outlet. Collapsing of the bag in an intermediate region impedes the effluence of fluid from the region that is furthermost from the outlet. That is not to say that collapsing of the bag is not fairly uniform. It is. But complete collapsing must proceed as stated for complete depletion of the bag's fluid content.

The function of the passive guide means is to manage collapsing of the bag by negating adverse resistances and enhancing propitious resistances, without comprising the attributes of the bag. And in so doing, the passive guide means prevents the proliferation and sustainment of fluid retention pockets that normally proliferate inside of flaccid bags, as they collapse, and block product from being dispensed. Thus, the passive guide means insures that complete emptying of the bag will not be impeded.

Until now, the use of passive flaccid bags for closed containment of dispensable fluid has been limited to baby bottles where, despite the collapsing problems, the bag provides an advantage over conventional bottles. Still there is a need for a baby bottle bag, as provided by the present invention, that overcomes the collapsing problem. This need also extends to other kinds of dispensers.

PRIOR ART

Related prior art bags are described in the following Bolk, U.S. Pat. No. 3,549,058 dated Dec. 22, 1970; Casey, U.S. Pat. No. 3,731,854 dated May 8, 1973; Giggard, U.S. Pat. No. 4,032,064 dated June 28, 1977; Roper et al., U.S. Pat. No. 3,738,538 dated June 12, 1973; Shaw et al., U.S. Pat. No. 3,989,165 dated Nov. 12, 1976.

Prior art patents show that many attempts have been made to provide a simple passive flaccid bag, for closed containment of product, that insures against the proliferation and sustainment of fluid retention pockets inside of the bag.

Prior art bags have been constructed having annular pleats, longitudinal pleats, a special shape rigid bottom, a rough inside surface, and expandable resiliently active walls, one or two of these attempts have had limited success. However they all have failed to meet the objective, to provide a simple passive flaccid bag. They are not simple, they are not passive, and they are not flaccid.

Many inventions that utilize collapsible bags either ignore the collapsing problem, or they provide a perforated straw or a grooved stick as a proposed dispensing path. These solutions are inadequate, in practice they are not effective. Other collapsible, passive flaccid bags that are commonly used for closed containment and dispensing of fluid are attitude sensitive. These bags are not considered to be relevant.

SUMMARY OF THE INVENTION

There is a need in household dispenser applications for a simple, reliable, collapsible, passive flaccid bag for closed containment of fluid product to be aspirated. The primary object of the present invention is to satisfy that need by providing a bag having a passive guide means that manages collapsing of the bag, insuring that complete emptying of the bag will not be impeded.

Another object is to provide a bag, as stated in the foregoing objective, that will reliably collapse regardless of attitude.

Another object is to provide a bag, as stated in the foregoing objectives, whereas, said passive guide means manages collapsing of the bag by negating adverse resistance and enhancing propitious resistance, and without compromising the attributes of the bag.

Another objective is to provide a bag, as stated in the foregoing objectives, whereas said passive guide means prevents proliferation and sustainment of fluid retention pockets inside of said bag.

These and other objectives will be seen from the following specifications and claims in conjunction with the appended drawings.

THE DRAWING

DETAILED DESCRIPTION OF THE INVENTION

Specific terminology resorted to in describing the illustrated embodiments of the present invention is not intended to be limiting. It is understood that this is for clarity and includes all technical equivalents which function in a similar manner to accomplish a similar purpose or result. Well known variations of prior art dispenser bags are contemplated to be inclusive in the present invention.

Figure 1:
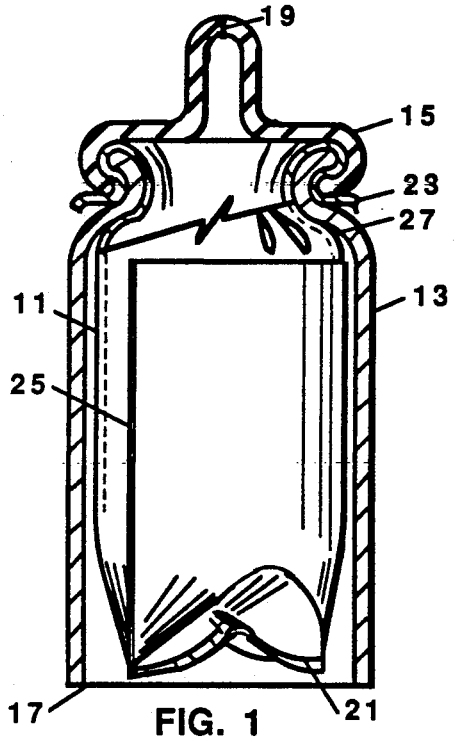
FIG. 1 is longitudinal cross sectional view demonstrating an application of the bag, of the present invention, whereas the bag serves as a bottle and is disposed in a baby bottle (bag) holder.

Referring to the drawing, particularly FIG. 1, shown therein is an impervious, collapsible, passive flaccid bag 11, which may interchangeably be referred to as a bottle bag, bag bottle, bottle or bag in describing the invention. The bag's primary function is to provide a means for closed containment of fluid product and facilitate aspiration of said fluid, without regard to the attitude of said bag. A practical use for said bag is as a baby bottle.

Therefore, bag 11 is shown in its filled configuration and disposed in a holder 13 that is commonly used to facilitate use of a bag as a baby bottle. An outlet, in this case, a baby bottle nipple 15 is disposed on said holder and closes the bag. The bottle holder and nipple do not form a part of the present invention, they are for demonstrative purposes only, and therefore they will not be described in any greater detail than necessary to describe the invention. References made to the holder and nipple may equally apply to other kinds of dispensers and should be considered accordingly.

In use, the holder 13 serves as a protective jacket for said bag, and the holder has an open bottom 17 that allows the bag exterior surface to be under atmospheric pressure. Nipple 15 is provided with a valvular slit 19. Said nipple serves as a one-way valve that permits aspiration of fluid contents from the bag but blocks entry of air into the bag. The bag facilitates aspiration by collapsing under atmospheric pressure, which is greater than the outlet pressure at the valve, as the bag's fluid content is depleted. And because air is blocked from entry into the bag, as fluid is depleted, the bag remains collapsed and holds the remaining fluid in dispensing communication with the valve.

Now relating more specifically to bag 11, the bag is preferably constructed in a conventional manner from a length of cylindrical thin wall plastic tubing that is pressed flat. One end of the tubing is heat sealed shut so as to form a transverse seam 21 that passes through the normal axis of the tubing. Said seam constitutes the bottom of the bag.

Other suitable bag materials and construction methods are contemplated, the material must be compatible with the fluid product. Said bottom seam may, as a matter of choice, be provided after said bag has been filled. And instead of having a bottom seam, the bag may be constructed from a sheet folded over to form a bottom and be provided with side seams, or the bag may be formed without a seam.

Bag 11, as seen in FIG. 1, has an open upper end 23 that is gathered and drawn over the mouth of the holder 13 and held in place by said nipple. Bag 11 has an integral passive guide means 25, also referred to as passive means, that is an essential portion of said bag, said passive guide means influences the collapsing configuration of said bag.

Said passive guide means is a very simple component, as illustrated herein, it is merely a rectangular shape flimsy film of plastic or other material that is laminated to an exterior surface of said bag. The guide means material, shape, thickness and construction may be varied corresponding to size and application of the bag and preference to a construction method.

The passive guide means may be provided in a variety of configurations, such as, it may be provided in the form of paint that has been applied to the bag surface, or as an increased thickness of the bag material, or a folded over panel of the bag material, or a thin sheet of plastic loosely inserted into the bag. And it may be patterned or varied in shape. For some contemplated bag materials, such as teflon, chemical etch preparation of the bag surface may be desirable, to improve adhesion for some guide means alternatives.

The width of said passive guide means, illustrated herein, is slightly less than the flat width of the bag, and the length of said guide means is such that said guide means extends from bottom region of said bag to a short distance beneath shoulder 27 of said holder.

Figure 2:
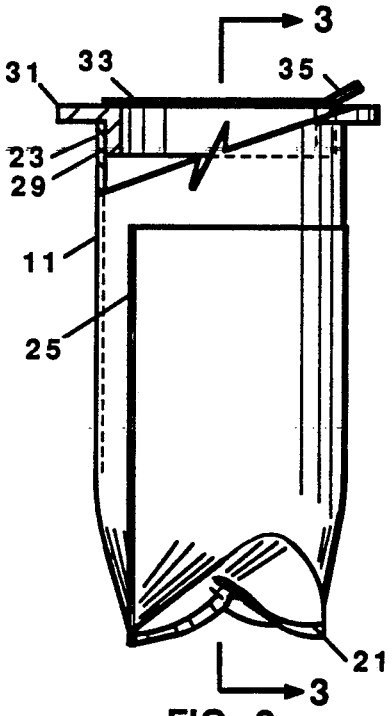
FIG. 2 is a side view showing the bag in its filled configuration having a closure fitting disposed on its upper end.
Figure 3:
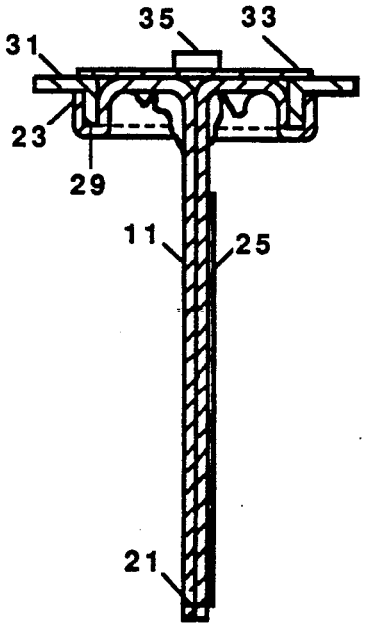
FIG. 3 is a cross sectional view, taken in the direction of arrows 3—3 of FIG. 2, illustrating the bag in a collapsed configuration.
Figure 4:
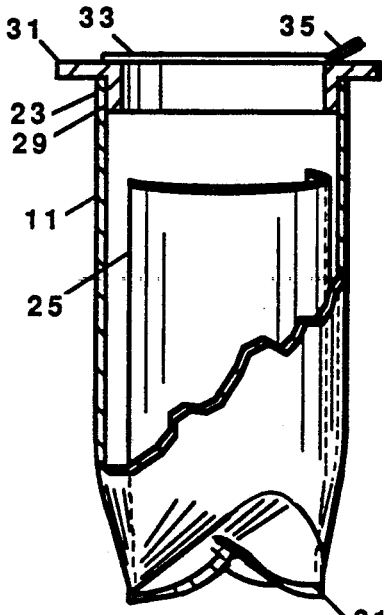

For applications where a shoulder is not provided, such as illustrated in FIG. 2, it is desirable to have the guide means end a short distance beneath the outlet to insure that the bag collapses, as seen in FIG. 3, against the outlet to facilitate complete emptying of said bag at the final stage of aspiration.

Being flimsy enables said guide means to be passive and yet be effective in influencing the collapsing of said bag. The guide means passively conforms to the substantially cylindrical filled configuration of the bag, whereas, the upper portion of said guide means assumes the contour curvature of the the bag walls and the lower end of the guide means is fairly straight, as determined by the bottom seam. Thus, the guide means does not interfere with the fill capacity of the bag.

However as the bag collapses the change in its contour from a cylindrical shape to an oval shape, due to atmospheric pressure acting against the exterior surfaces of the bag when fluid is aspirated therefrom, causes said guide means to conform to the shape change and in so doing said guide means increases in stiffness across its width.

It is noted that the flat form stiffness across the width of the guide means is substantial, and in a semi-circular curve form it is without stiffness in the width direction. But, as the curve form flattens the width stiffness of the guide means increases, particularly as the flat form is approached. And this increased stiffness keeps the bag taut and thereby prevents proliferation and sustainment of fluid retention pockets inside of said bag.

In the lengthwise direction the width curvature enhances the stiffness of said guide means, and this stiffness restricts movement of said bag toward the outlet sufficiently to prevent premature collapsing of the bag at the outlet and blockage of fluid passage thereat. The bag span between said guide means and the outlet facilitates final stage collapsing of the uppermost portion of the bag against the outlet for complete aspiration of fluid from said bag.

The term stiffness as used in the foregoing is merely an alternative way of stating resistance. The resistance influences the bag to collapse, inwardly from opposite sides, in a direction that is perpendicular to the plane surfaces of said guide means. Thus, it should be understood that passive guide means 25 manages collapsing of bag 11 by negating adverse resistance and enhancing propitious resistance, without compromising the attributes of the bag.

The function of the passive guide means is to manage collapsing of the bag, and in so doing, the passive guide means prevents the sustainment and proliferation of fluid retention pockets that normally proliferate inside of flaccid bags and block the product from being dispensed. Thus, the passive guide means insures that complete emptying of the bag will not be impeded.

In FIG. 2 said bag in its filled configuration is shown, in its preferred embodiment, having a cylindrical outlet fitment 29 disposed in open end 23. This fitment is heat sealed in place in said open end, or affixed to said open end by any other appropriate means. Said fitment is shown having a radially extending annular flange 31 that overlies open end 23 and provides a convenient means for supporting said bag in mouth of a dispenser (not shown), and it facilitates prefilling and closure of said bag prior to placement in said dispenser.

Closure of said bag is provided by a conventional temporary peel off seal disc 33 that is affixed to and overlies said fitment, thus providing a removable closure means for said bag. Said seal disc is provided with a pull tab 35 that facilitates removal of said seal disc after said bag is in place in said dispenser (not shown).

In FIG. 3 said bag, described in reference to FIG. 2, is shown merely to illustrate said bag in a completely collapsed state. And although seal disc 31 is shown affixed to fitment 29, in FIG. 3, it should be understood that the seal disc must be removed before the bag can be collapsed.

It is thought that the invention and its advantages will be understood from the foregoing description, and it is apparent that various changes may be made in the form, construction and arrangement of parts without departing from the spirit and scope of the invention or sacrificing its material advantages, the form heretofore described and illustrated in the drawings being merely embodiments thereof.

Having described my invention, reference should now be had to the following claims.

I claim:

1. A collapsible, passive, flaccid bag bottle for closed containment of fluid to be aspirated therefrom, which comprises:

a passive flaccid bag being collapsible and having, integral therewith, at least one passive means that manages collapsing of said bottle;

said passive means being a means which promotes complete collapsing of said bottle without regard to the attitude of said bottle;

whereas, said passive means insures against proliferation and sustainment of fluid retention pockets in said bottle without regard to the attitude of said bottle.

2. In the invention of claim 1, said passive flaccid bag having an open end and a fitment, being a means of support for said bottle in a dispenser, affixed to said open end.

3. In the invention of claim 2, said bag being in a filled configuration, and a removable closure means being affixed to said fitment.

4. In the invention of claim 1, said passive means being loosely disposed inside of said bag.

5. In the invention of claim 1, said passive means being disposed on a surface of said bag.

6. In the invention of claim 1, said passive means being intrinsical with said bag.

7. In the invention of claim 1, said bag having an upper outlet end and a closed bottom; and said passive means being a flimsy, substantially rectangular shape, film of plastic which extends from the bottom region of said bag to a short distance from said outlet end so as to assure complete emptying of the bag at final stages of aspiration.

* * * * *